United States Patent [19]

Tiek et al.

[11] 4,362,379

[45] Dec. 7, 1982

[54] APPARATUS SUITABLE FOR PRODUCING DUPLEX COPIES FROM SIMPLEX ORIGINALS

[75] Inventors: Fredericus J. A. M. Tiek; Jan B. Stienstra, both of Venlo, Netherlands

[73] Assignee: OCE-Nederland B.V., Venlo, Netherlands

[21] Appl. No.: 266,051

[22] Filed: May 21, 1981

[30] Foreign Application Priority Data

Jun. 4, 1980 [NL] Netherlands ..... 8003240

[51] Int. Cl.[3] ..... G03G 15/00

[52] U.S. Cl. ..... 355/3 SH; 271/3.1; 355/23; 355/77

[58] Field of Search ..... 355/3 SH, 14 SH, 23, 355/24, 26, 77; 271/3.1

[56] References Cited

U.S. PATENT DOCUMENTS

| | | | |
|---|---|---|---|
| 4,116,558 | 9/1978 | Adamek et al. | 355/24 |
| 4,125,325 | 11/1978 | Batchelor et al. | 355/26 |
| 4,172,655 | 10/1979 | Wood | 355/26 |
| 4,330,197 | 5/1982 | Smith et al. | 355/23 X |

FOREIGN PATENT DOCUMENTS 2000749 1/1979 United Kingdom .

OTHER PUBLICATIONS

Research Disclosure nr. No. 14927, Sep. 1976.

IBM Technical Disclosure Bulletin vol. 22 No. 7, Dec. 1979.

*Primary Examiner*—R. L. Moses

*Attorney, Agent, or Firm*—Albert C. Johnston

[57] ABSTRACT

A copying apparatus which automatically produces duplex copies in logical page sequence from simplex originals comprises transport paths for conveying originals to and from a copying position, imaging means for producing an image of an original onto a copy sheet, a first hopper to collect single-sided copy sheets, a second hopper to collect duplex copies and delivery means for delivering the duplex copies into the second hopper. The delivery means comprises a first delivery path and a second delivery path, and a detector in the transport path of the originals determines whether the number of originals to be copied is even or odd, thus causing the duplex copies to be delivered through the first or the second delivery path, depending on whether an even or an odd number of originals has been detected by the detector. The apparatus disclosed is also suited for programmed production of simplex copies from simplex originals, duplex copies from duplex originals, and simplex copies from duplex originals.

6 Claims, 1 Drawing Figure

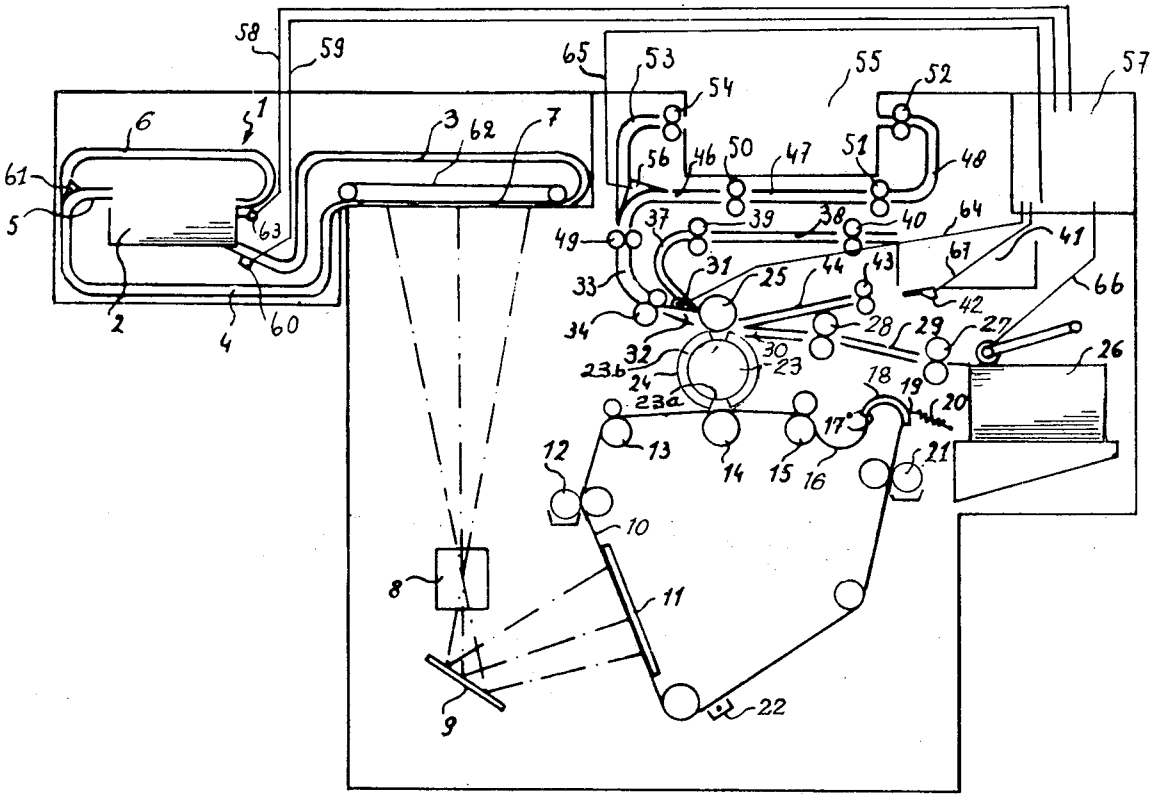

APPARATUS SUITABLE FOR PRODUCING DUPLEX COPIES FROM SIMPLEX ORIGINALS

The present invention relates to a copying apparatus suitable for producing duplex (double-sided) copies from a report or document consisting of simplex originals (single-sided originals).

A copying apparatus for making duplex copies from simplex originals is known from the United Kingdom Patent Application No. 2 000 749. As described in that application, the originals of a stack are located face-up in logical page sequence, with page 1 on top, are fed one after another from the bottom of the stack along a first transport path to the exposure plate of the copying apparatus and, after exposure, are returned along a second transport path to the top of the stack, where they are delivered in their original orientation. During a first pass of the originals across the exposure plate only those originals fed as the first, third, fifth . . . etc. are copied and the single-sided copy sheets bearing images of these originals are delivered into a first hopper of the copying apparatus. During a second pass of the same originals across the exposure plate those originals are copied which were not copied during the first pass and the images of these originals are placed on the still unprinted sides of the copy sheets by delivery of the copy sheets from the first hopper to the imaging means of the copying apparatus. The duplex copies thus made are delivered to a second hopper.

A disadvantage of that known copying apparatus is that the so-called last-page problem may result in the production of duplex copies. By the last-page problem is meant the occurrence of a blank page on the back of the first sheet of a set of duplex copies, instead of on the last sheet as is usual, when a report or document consisting of an odd number of simplex originals is to be copied in duplex mode. To avoid this last-page problem it has been proposed to make an odd number of simplex originals even in the number of sheets by adding a blank sheet as a last sheet to the stack of originals. This, however, has the disadvantage that the operator of the copying apparatus, before starting the copying assignment, has to count the number of originals, which wastes time, especially when a large number of originals is involved, and involves danger of a counting error that will itself introduce the last-page problem.

It is the principal object of the present invention to provide a copying apparatus by which duplex copies can be automatically made of simplex originals with avoidance of the last-page problem.

A copying apparatus in accordance with the present invention is of a kind heretofore known in that it comprises transport paths for conveying originals of a set one after another to and from a copying position, imaging means for producing an image of an original on a copy sheet, a first hopper to collect copy sheets imaged (printed) on one side, means for supplying the single-sided copy sheets from the first hopper to the imaging means a second time in duplex copying to provide their unprinted faces with images, and delivery means for delivering the duplex copies to a second hopper. According to this invention, however, the delivery means includes two delivery paths a first of which delivers the duplex copies with their side that was last imaged facing upward and the second of which delivers the duplex copies with their side that was first imaged facing upward; a detector is provided in the transport path for the originals to determine whether the number of originals is even or odd; and the detector is connected with control means which cause the duplex copies to be delivered through either the first or second delivery path, depending on whether an even or an odd number of originals has been detected.

By virtue of the arrangement which provides a detector in the transport path of the originals to determine whether the number of originals present in the set is even or odd and provides two different paths for delivering the duplex copies, with the delivery of the duplex copies along the first or the second delivery path depending on whether an even or an odd number of simplex originals has been detected by the detector, the last-page problem is solved by the apparatus itself. Thus, it is no longer necessary for an operator to count the originals in a set, and errors in the making of duplex copies from simplex originals are avoided.

The above mentioned and other objects, features and advantages of the invention will be further evident from the following detailed description and the accompanying drawing of an illustrative embodiment of the invention.

The drawing is a schematic sectional view of a copying apparatus in accordance with the invention.

The copying apparatus shown is an electrophotographic copying apparatus comprising a device 1 for supplying and delivering originals, which device comprises a holder 2 for a set of the originals, a sheet feeding device of conventional design (not shown) which removes the bottom-most original sheet each time from the stack of originals placed in the holder 2, a path for supplying the originals for copying, which path comprises a guide 3 ending beneath an endless transport belt 62 that runs over an exposure plate 7 of the copying apparatus, and two return paths defined by guides 4 and 5 and guides 4 and 6, respectively.

Transport means, such as transport rollers (not shown), are provided in the guides 3, 4, 5 and 6 for transporting the originals. Arranged at the entry to guides 5 and 6 is a switch 61 having two positions in which, respectively, guide 5 or guide 6 is open and the other of these guides closed. Device 1 also comprises a stack separation element 63 which extends partially into holder 2 and is supported on the stack of originals present therein. The stack separation element 63 serves to separate the originals returned into the holder 2 from those originals which are still to be fed to and from the exposure plate 7. After all originals underlying the separation element 63 have been fed from the holder, means of known construction (not shown) cause the element 63 be withdrawn from the holder 2 and then to be returned onto the top of the stack of originals contained in the holder.

An original delivered to explosure plate 7 through guide 3 is illuminated by flash lamps (not shown), and the image of this original is projected via a lens 8 and a mirror 9 onto an endless photoconductive belt 10 which moves with a constant velocity and is kept flat in a projection plane at the face of a suction box 11. Before the photoconductive belt traverses the projection plane, the belt has been charged electrostatically by a charging device 22. After passing the projection plane, the photoconductive belt 10 traverses a developing station 12, where the electrostatic charge image formed on the belt is developed, for example by developing powder. The belt 10 then passes over a drive roller 13, which may interact with a back pressure roller, and the belt subsequently passes over a pressure roller 14 in an image transfer station. After traversing the image transfer station the photoconductive belt 10 passes over a drive roller 15 and into a loop 16 leading onto a stationary, smooth or hairy surface 17 where the belt is aligned by lateral guides 18 and by being kept pressed by a cloth 19 tensioned by a spring 20. The belt 10 subsequently traverses a cleaning station 21, where residual developer powder is removed, and finally it again passes the charging device 22 to be electrostatically recharged so that a subsequent electrostatic charge image can be formed on the belt.

Above the photoconductive belt 10 and the pressure roller 14 the image transfer station includes a roller 23 which takes up a powder image from the belt. The roller 23 is provided with a soft, resilient covering layer 24, for example of silicone rubber, and, allowing for some elastic contraction of its covering 24, is driven at the same peripheral velocity as the velocity of the photoconductive belt 10. The covering 24 of the roller 23 is heated by heating means (not shown) which, for example, may be provided inside the roller 23. The roller 23 has two diametrically opposite recessed areas 23*a*, 23*b*, which as shown are areas having no covering layer. The drive (not shown) of the roller 23 is so designed that when no image transfer is to take place, the roller 23 is stopped in the position shown and thus makes no contact with the photoconductive belt 10.

During every image transfer the roller 23 makes one complete revolution, in the course of which a powder image from the photoconductive belt 10 is transferred first to the soft, resilient covering 24, where the image becomes sticky as a result of the heat supplied to the covering, and is then transferred and at the same time fixed onto a copy sheet fed underneath a pressure roller 25. The pressure roller 25 may also be provided with a resilient covering of the same form as that on roller 23. Unimaged copy sheets are fed from a supply stack 26 to the transfer station via rollers 27 and 28 and guides 29 and 30.

Beyond the transfer station, viewed in the direction of movement of the copy sheets, are entries to guides 32 and 37, in front of which is mounted a switch 31 that can take up two positions in which, respectively, either guide 32 or guide 37 is open for transporting a copy sheet. A copy sheet entering guide 37 is transported to a first hopper 41 through guides 37 and 38 with the aid of transport rollers 39 and 40. From the first hopper 41 the same copy sheet can be delivered again via a sheet feeding device 42, transport rollers 43 and guide 44 to the image transfer station for imaging on the back of the copy sheet.

The final, duplex copies are delivered to a second hopper 55 through either of two delivery paths which in common comprise the guides 32 and 33 provided with transport rollers 34 and 49 from these guides the copies are delivered either through a guide 53 provided with transport rollers 54 or through guides 46, 47 and 48 provided with transport rollers 50, 51 and 52. The entries to guides 46 and 53 are controlled by a switch 56 that can take either of two positions, in each of which one of the two guides 46 and 53 is closed off and the other of them is open so that a copy sheet passing from guide 33 will enter the other of guides 46 and 53.

The delivery path formed by the guides 32, 33 and 53 is curved so that a copy sheet passed through it is delivered into hopper 55 with that side of the sheet facing upward which had faced toward roller 23 in the transfer station.

On the other hand, the delivery path formed by the guides 32, 33, 46, 47 and 48 is curved so that a copy sheet passed through it is delivered into hopper 55 with that side of the sheet facing upward which had faced away from roller 23 in the transfer station.

For controlling the various functions of the apparatus, a control unit 57 is provided which may comprise, for example, a microcomputer. Its memory stores in known manner a program for performing the operations associated with a copying cycle, and also a program for performing a copying assignment to produce duplex copies from a report or other document (set of original sheets) consisting of simplex originals.

Input and output lines of the control unit 57 for performing the latter program are indicated in the drawings. They include input lines 58 and 59 which furnish control unit 57 with information concerning the document or report to be copied and output lines 64, 65, 66 and 67 along which the supply of copy sheets from the stack 26 or from the first hopper 41, as well as the positions of the switches 31 and 56 in the delivery paths of the copy sheets, are controlled.

Whenever the last original has been removed from the stack in holder 2, a signal is emitted to the control unit 57 via the input line 58 which is connected to the separation element 63 supported by the stack of originals. This signal may be emitted at the moment when the stack separation element 63 contacts the bottom of holder 2, or while the stack separation element 63 is withdrawn from the holder 2 which occurs after the last underlying original has been delivered, or while element 63 is being put back on the top of the stack of originals, the last original meanwhile having been returned to the stack.

The second input line 59 is connected to a sheet detector 60 which is installed in the guide 3 through which the originals are supplied to be copied. Detector 60 senses the originals fed past it and emits corresponding count signals. The control unit 57 receives signals via input line 59, thus being informed whether the total number of originals in holder 2 was even or odd. The count from the detector 60 is stored as soon as all the originals have been transported through guide 3 for the first time, or each time after the last original of the stack in holder 2 has been transported through guide 3. The detector 60 comprises, for example, a conventional sheet detection system that will emit a signal to a data flip-flop whenever an original passes through guide 3. Such a sheet detection system is described, for example, in United Kingdom patent specification No. 1,533,630.

The positions of the switches 31 and 56 and the respective means for transporting copy sheets from the stack 26 and from the first hopper 41 are controlled by the control unit 57 via the output lines 64, 65, 66 and 67.

The operation of the copying apparatus when carrying out the copying assignment to produce duplex copies from a report or document consisting of simplex originals is as follows:

A stack of simplex originals is placed in logical order, with their image sides facing upward and page 1 on top, in the holder 2 of the device 1 for supplying the originals. The stack separation element 63 is placed on top of the stack of originals, and the simplex-to-duplex program is selected on a control panel of the copying apparatus. The control unit 57 then delivers via output line 64 a signal that causes switch 31 to take the position in which guide 37 is open, and causes switch 61 at the entries to guides 5 and 6, through one of which the originals are returned to holder 2, to take the position in which guide 5 is open.

The originals are fed one after another from holder 2 through guide 3 and onto the exposure plate 7, and in the course of this pass of the original copies are made from the first, third, fifth . . . etc. of the originals fed to the exposure plate 7. Each of these copies is made on a copy sheet of a succession of previously unimaged copy sheets which are supplied from stack 26 to be imaged at the transfer station between rollers 23 and 25. The single-sided copies thus produced are delivered to the first hopper 41 through the guides 37 and 38 with the aid of the transport rollers 39 and 40. When all the originals of the stack have been fed through, a signal is emitted via input line 58 to control unit 57, whereupon the count of the detector 60 as tallied via input line 59 is ascertained by control unit 57. At this same stage the stack separation element 63 is withdrawn from the holder 2 and, after all the originals have been returned to holder 2 via the return path of guides 4 and 5, element 63 is returned to the top of the stack of originals.

If an even number of originals is determined to be present, the control unit 57 delivers via output line 65 a signal that causes switch 56 to take its position in which the entry to guide 53 is open, while via output line 64 switch 31 is positioned so that the entry to guide 32 is open. The originals are now fed again one after another onto the exposure plate 7, but now the originals copied are those, such as the second, fourth, six . . . etc. of the stack, that were not copied during the first pass of the originals from the holder. The images of these originals are produced onto the still unimaged faces of the copy sheets collected in hopper 41 by delivery these sheets through guide 44, by the sheet feeding device 42 and rollers 43, to the image transfer station of rollers 23 and 25. The duplex copies thus produced are delivered into the second hopper 55 through the guides 32, 33 and 53 with the aid of the transport rollers 34, 49 and 54.

If on the first pass of the originals the detector 60 determines that an odd number of simplex originals was present in the holder 2, the copying assignment is continued in the following manner:

Switches 31 and 56 are brought into the positions in which the entries to guides 32 and 46 are open, and the sheet feeding device 42 is energized once, as a result of which the bottom-most copy sheet lying in the hopper 41 is delivered to the second hopper 55 through the guides 44, 32, 33, 46, 47 and 48 with the aid of the transport rollers 43, 34, 49, 50, 51 and 52.

Then the originals in holder 2 are fed through one after another for a second time, during which pass of the originals copies are made from those which were not copied during the first pass, i.e. from the second, fourth, sixth . . . etc., of the originals, and their images are produced at the transfer station of rollers 23 and 25 onto the unimaged (unprinted) faces of the previously single-sided copy sheets while these sheets are supplied from hopper 41. The resulting duplex copies are delivered to hopper 55 through the guides 32, 33, 46, 47 and 48.

If more than one set of duplex copies is to be produced from the stack of simplex originals placed in holder 2, the procedure on the first and last passes of the originals is the same as described above. During each of the passes intervening between the first and the last, however, all the originals are copied and their respective images are produced alternately onto an unprinted copy sheet and onto a single-sided copy sheet that was produced from an unprinted copy sheet in the next preceding pass of the originals.

Thus, when an even number of originals is present as sensed by the detector 60 at the end of the first pass of the originals, and before the second pass is started, switch 56 is set into the position in which the entry to guide 53 is open. Switch 31 then remains in the position in which guide 37 is open, but thereafter every time a copy sheet passes switch 31 this switch is moved from one position to its other position. Thus, during all passes of the originals after the first up to and including the next to last pass of the originals, single-sided copies are delivered to the first hopper 41 and duplex copies are delivered through the guides 32, 33 and 53 to the second hopper 55.

On the other hand, when an odd number of originals is present as determined by the detector 60 at the end of the first pass of the originals, before the second pass is started the switches 31 and 56 are set into the positions in which the guides 32 and 46 are open and, subsequently, the bottom-most copy sheet from hopper 41 is delivered to hopper 55 through the guides 44, 32, 33, 46, 47 and 48. Switch 31 is then brought into its other position, thus opening the entry to guide 37, and the second pass of the originals is started. During this second pass and thereafter up to and including the next to last pass of the originals, switch 31 is switched again from one position to the other every time a copy sheet passes this switch. Moreover, after every pass of the originals the bottom-most copy sheet from hopper 41 is delivered to hopper 55 through the guides 44, 32, 33, 46, 47 and 48.

The control unit 57 of the copying apparatus herein disclosed may be provided with programs for performing other copying assignments in addition to the assignment of making duplex copies from simplex originals. Among such programs, of course, is one for making simplex copies of simplex originals. Other programs may also be provided for performing the copying assignments of making duplex copies from duplex originals and making simplex copies from duplex originals.

The copying assignment of duplex originals to duplex copies is carried out as follows:

The duplex originals are placed in their logical order in holder 2 with page 1 facing upward. Upon selecting the duplex-to-duplex program, the switches 31, 56 and 61 are brought into their positions in which the guides 37, 46 and 6, respectively, are open. On the first pass of the originals, the image sides that were facing upward in the stack are copied, the images are transferred to unprinted copy sheets supplied from the stack 26 and the resulting single-sided copy sheets are delivered into hopper 41. Meanwhile, the originals are returned to the holder 2 through the return path formed by the guides 4 and 6, thus being inverted twice so that they have an inverted orientation as compared with their original position in the holder 2. After the first pass of the originals, the supply of unprinted copy sheets is stopped, the sheet delivery device 42 is activated, and switch 31 is positioned so that guide 32 is open. On the second pass of the originals their sides that have not yet been copied are reproduced and the images are provided onto the previously unimaged faces of the single-sided copy sheets while these sheets are supplied from hopper 41. The duplex copies are delivered to hopper 55 through guides 32, 33, 46, 47 and 48.

The copying assignment of duplex originals to simplex copies is carried out as follows:

The originals are placed in their logical order in holder 2 with page 1 facing upward. Upon selecting the duplex-to-simplex program, the switches 31 and 61 are brought into their positions in which guides 37 and 6, respectively, are open. On the first pass of the originals their sides that were facing upward in holder 2 are copied. The resulting single-sided copy sheets are fed to hopper 41 through guides 37 and 38, but before every copy sheet receives its image an unimaged copy sheet is fed from stack 26 to hopper 41 via the guides 29, 30, 37 and 38 with the rollers 23 and 25 disposed in their disengaged position. After the first pass of the originals, which again are returned to the holder 2 via guide 6, so in an inverted orientation, the switches 31 and 56 are switched to their positions in which the guides 32 and 53 are open. Then, during the second pass of the originals their sides that were not copied in the first pass are reproduced and the images are provided onto the unimaged copy sheets that were previously fed into the hopper 41. After the making of every copy during the second pass of the originals, a copy sheet that had received an image in the first pass of the originals is delivered from hopper 41 to the copy hopper 55 through the guides 44, 32, 33, 46, 47 and 48. The switch 56 is brought from one of its positions to the other every time of a copy passes to hopper 55. Thus, all of the copies produced from the second pass of the originals are delivered to hopper 55 through the guides 32, 33 and 53, and all of the copies produced from the first pass of the originals are delivered to hopper 55 through the guides 32, 33, 46, 47 and 48. As a result, the copies are delivered into hopper 55 in the proper page sequence corresponding to that of the originals.

To prevent copies delivered into the hoppers 41 and 55 from sticking together while they are still hot, the supply paths for these hoppers may include means for cooling the copies. The copies may be cooled, for example, by blowing air through the supply paths. The air velocity may be as high as about 5 m/sec. Higher air velocities generally are not desirable because they tend to generate disturbing noise.

Any tendency of copies to stick together in hopper 41 can also be avoided by the use at 41 of a hopper having a plurality of compartments which respectively receive one copy sheet on every occasion of the delivery of copy sheets to this hopper. In such a case, in performing the copying assignment to produce a number of sets of duplex copies from a set of simplex originals, the compartments are emptied one after another (beginning with the compartment that was filled first) on the second and up to and including the next to last pass of the originals, and fresh-imaged copy sheets are delivered into the compartments at the moments of the compartments being emptied, or just afterward.

We claim:

1. In a copying apparatus for producing duplex copies from a set of simplex originals, including transport paths for conveying the originals one after another into and from a copying position, imaging means for providing onto a copy sheet an image of an original in copying position, a first hopper to collect copy sheets imaged on only one side thereof, means for supplying said copy sheets one at a time from the first hopper to said imaging means to provide images on their other sides, thus producing duplex copies, and delivery means for delivering the duplex copies from said imaging means to a second hopper, the improvement which comprises in said delivery means a first delivery path by means of which said duplex copies are deliverable into said second hopper with their last imaged side facing upward and a second delivery path by means of which said duplex copies are deliverable into said second hopper with their first imaged side facing upward, detector means for detecting whether the number of originals present in said transport paths is even or odd, and means for causing the duplex copies to be delivered through said first delivery path or said second delivery path according to whether the number of originals detected by said detector means is even or odd.

2. Copying apparatus according to claim 1 said delivery paths having in common a path leg to receive sheets from said imaging means and guide the sheets past a switch means that is positionable to direct the sheets from said path leg into one or the other of said delivery paths, said first delivery path being arranged to invert sheets passed through it once during their delivery into said second hopper and said second delivery path being arranged to invert sheets passed through it twice during their delivery into the second hopper.

3. Copying apparatus according to claim 2 and including a primary delivery path to receive sheets one at a time from said imaging means and to invert each of the sheets and pass it into said first hopper, said primary delivery path and said path leg having respective entries near said imaging means and having in common at said entries a sheet switching means that is positionable to direct sheets passing from said imaging means into either one or the other of said entries.

4. Copying apparatus according to claim 2 or 3, said imaging means comprising an image carrier movable through a transfer station to transfer an image to a copy sheet being moved through said station, means for pressing the copy sheet against the image carrier and means for providing a gap between said pressing means and said carrier when an image is not to be transferred at said station, said supplying means being operable to feed a single-sided copy sheet from said first hopper through said gap and into said path leg without imaging of the sheet.

5. Copying apparatus according to claim 4 and including a first sheet feed means for feeding unimaged copy sheets one at a time to said transfer station and thence via said primary path for delivery into said first hopper, said supplying means including means to feed sheets one at a time to said transfer station from the bottom of a stack of sheets collected in said first hopper, said first sheet feed means being operable to feed copy sheets to said transfer station either for being imaged there by contact with said image carrier or for being passed through said gap for delivery unimaged into said first hopper.

6. A method for making duplex copies from a set of simplex originals which comprises:

arranging the originals in a holder in their logical page sequence with the image sides facing upward and the first page of the set on top;

feeding the originals in a first pass thereof one after another from the bottom of the holder to a copying position and thence back into the top of the holder with their image sides facing upward;

in the course of said first pass forming copy images of alternate originals of the set, applying the respective copy images onto copy sheets fed one after another past an imaging station and collecting the resulting single-sided copies with their imaged sides facing upward in a first hopper;

detecting whether an even or an odd number of originals was present in the set of originals fed from the holder in said first pass;

feeding the originals one after another in a second pass thereof from the bottom of the holder to the copying position and thence back into the top of the holder and in the course of this pass forming copy images of the other originals of the set and applying the respective copy images onto the imaged sides of single-sided copies fed one at a time to said imaging station from the bottom of said first hopper, thus forming duplex copies;

if an even number of originals was detected present in the set, delivering the duplex copies one at a time from said imaging station through a first delivery path that delivers the duplex copies into a second hopper with their last imaged side facing upward;

but if an odd number of originals was detected present in the set, before commencing said second pass delivering the bottommost single-sided copy from said first hopper through said imaging station without again imaging it and thence through a second delivery path that delivers it into said second hopper with its imaged side facing upward, and then delivering the duplex copies formed on said second pass one at a time through said second delivery path into said second hopper with their first imaged side facing upward.

* * * * *